US009812827B2

(12) United States Patent
Guo et al.

(10) Patent No.: US 9,812,827 B2
(45) Date of Patent: Nov. 7, 2017

(54) CONNECTOR HAVING TONGUE PORTION WITH PERIPHERAL SUPPORT UNITARILY FORMED WITH METALLIC SHELL

(71) Applicant: FOXCONN INTERCONNECT TECHNOLOGY LIMITED, Grand Cayman (KY)

(72) Inventors: Jing-Jie Guo, HauiAn (CN); Jun Zhao, HuaiAn (CN); Cai-Yun Zhang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/377,928

(22) Filed: Dec. 13, 2016

(65) Prior Publication Data

US 2017/0201053 A1 Jul. 13, 2017

(30) Foreign Application Priority Data

Jan. 9, 2016 (CN) ..... 2016 1 0010896

(51) Int. Cl.

| | |
|---|---|
| ***H01R 13/648*** | (2006.01) |
| ***H01R 24/64*** | (2011.01) |
| ***H01R 12/75*** | (2011.01) |
| ***H01R 13/6581*** | (2011.01) |
| *H01R 107/00* | (2006.01) |

(52) U.S. Cl.
CPC ..... *H01R 24/64* (2013.01); *H01R 12/75* (2013.01); *H01R 13/6581* (2013.01); *H01R 2107/00* (2013.01)

(58) Field of Classification Search
CPC ..... H01R 24/64; H01R 13/6581; H01R 12/75
USPC ..... 439/607.4
See application file for complete search history.

(56) References Cited

U.S. PATENT DOCUMENTS

| | | | | |
|---|---|---|---|---|
| 9,525,227 | B2 | 12/2016 | Little et al. | |
| 2015/0044886 | A1* | 2/2015 | Little | H01R 12/75 439/55 |
| 2015/0072562 | A1 | 3/2015 | Little | |

FOREIGN PATENT DOCUMENTS

| | | |
|---|---|---|
| TW | M499683 | 4/2015 |

* cited by examiner

*Primary Examiner* — Javaid Nasri
(74) *Attorney, Agent, or Firm* — Wei Te Chung; Ming Chieh Chang

(57) ABSTRACT

An electrical connector includes an insulative housing, a plurality of contacts disposed in the housing, and a metallic shield enclosing the housing. The contacts includes a row of first contacts and another row of second contacts. The insulative housing includes a main base and a tongue portion extending forwardly from the body. The metallic shield includes a main body, a tubular section extending forwardly from the main body, an inner part forwardly extending from the main body and inside said tubular section. The inner part forms a receiving space in which the tongue portion is received.

18 Claims, 13 Drawing Sheets

CONNECTOR HAVING TONGUE PORTION WITH PERIPHERAL SUPPORT UNITARILY FORMED WITH METALLIC SHELL

BACKGROUND OF THE INVENTION

1. Field of the Invention

The present invention relates to an electrical connector, and particularly to an electrical receptacle connector with a reinforced tongue portion thereof.

2. Description of Related Art

U.S. Pat. No. 9,525,227 issued on Dec. 20, 2016, discloses an electrical Type C receptacle connector with an inner metallic collar assembled upon a root region of the tongue portion for EMI (Electro-magnetic Interference) shielding consideration. Anyhow, the discrete metallic collar is odd and costs relatively much labor for assembling, thus complicating the whole manufacturing process. In addition, the stamped/bent metallic shield of the receptacle connector is relatively flexible which may not endure an unexpected severe mating force.

An improved electrical connector with flexibility of adjustment of the numbers of the corresponding terminal/cable, is desired.

SUMMARY OF THE INVENTION

An electrical connector includes an insulative housing, a plurality of contacts disposed in the housing, and a metallic shield enclosing the housing. The contacts includes a row of first contacts and another row of second contacts. The insulative housing includes a main base and a tongue portion extending forwardly from the body. The metallic shield includes a main body, a tubular section extending forwardly from the main body, an inner part forwardly extending from the main body and inside said tubular section. The inner part forms a receiving space in which the tongue portion is received.

The metallic shield is made by powder metallurgy wherein the inner part includes a frame structure linked to the main body and enclosing the root region of the tongue portion, a pair of side arms forwardly extending from the frame structure and having two opposite top and bottom surfaces which are essentially flush with opposite top and bottom surfaces of the tongue portion.

The inner part further includes a pair of front arms respectively extending toward each other from the corresponding side arms, each front arm having a positioning post extending rearwardly/inwardly from an inner surface thereof. The insulative housing forms a pair of holes to receive the positioning posts, respectively.

The side arm forms a groove to receive the insulative housing, and the insulative housing includes the side face and the corresponding engagement block received within the groove of the corresponding side arm.

The frame structure includes opposite top and bottom plates and two side plates linking the top plate and the bottom plate, wherein the top and bottom plates respective cover opposite planes of the root region of the tongue portion.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
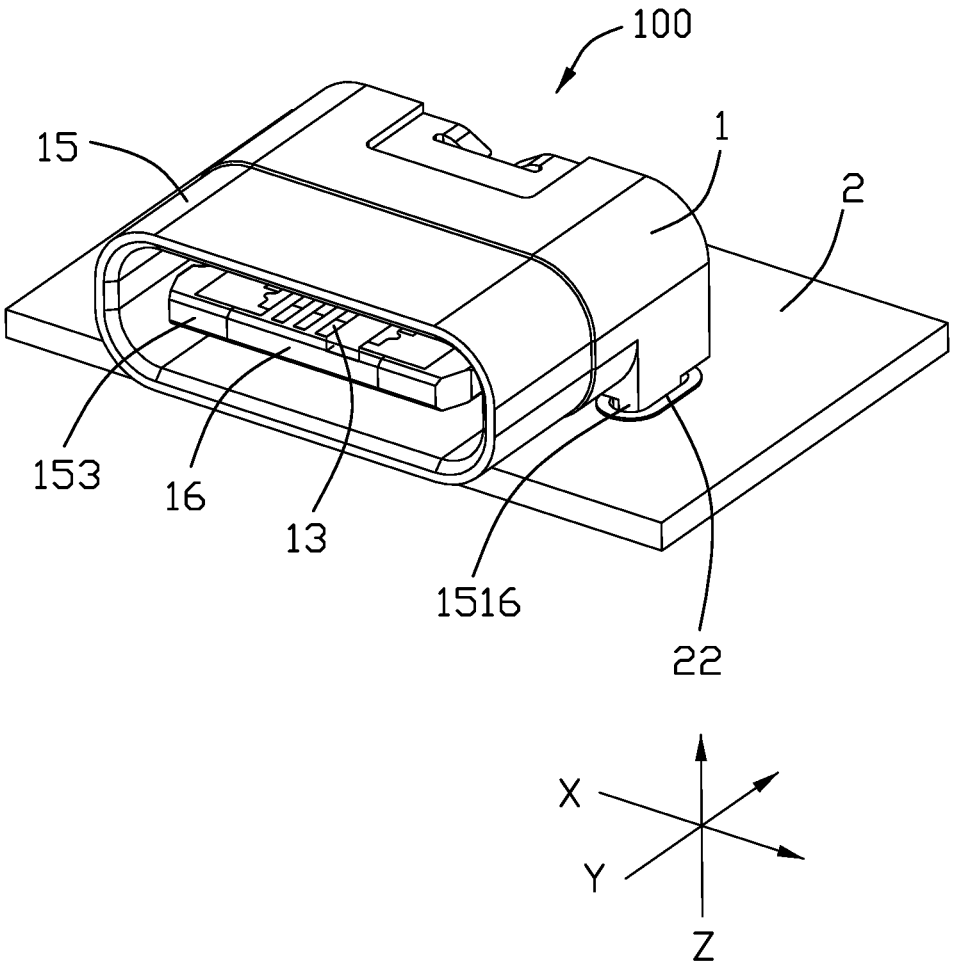
FIG. 1 is a downward assembled perspective view of an electrical connector assembly according to the presently preferred embodiment of the invention.
Figure 2:
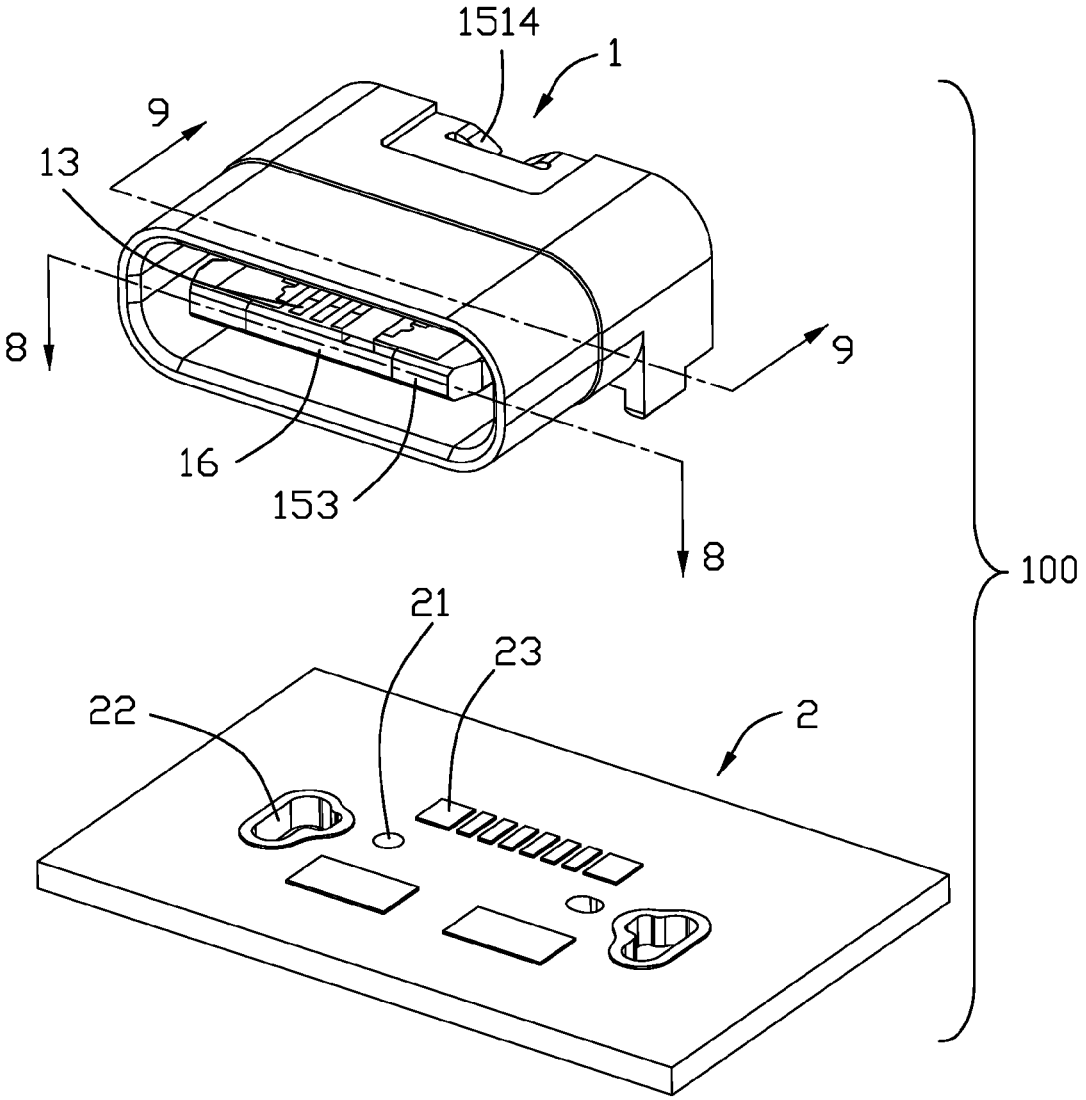
FIG. 2 is an exploded perspective view of the electrical connector assembly of FIG. 1.
Figure 3:
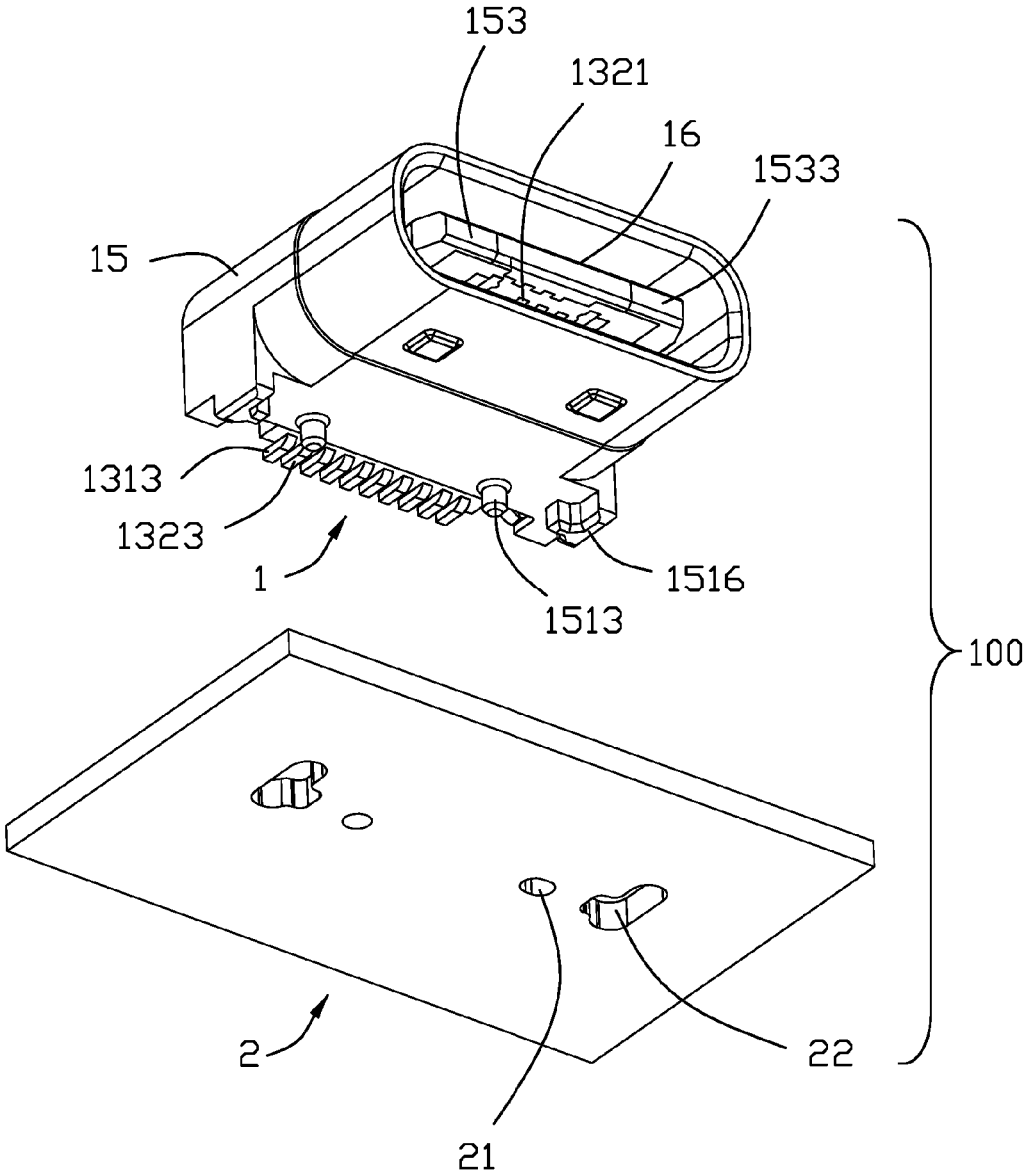
FIG. 3 is an upward exploded perspective view of the electrical connector assembly of FIG. 2.
Figure 4:
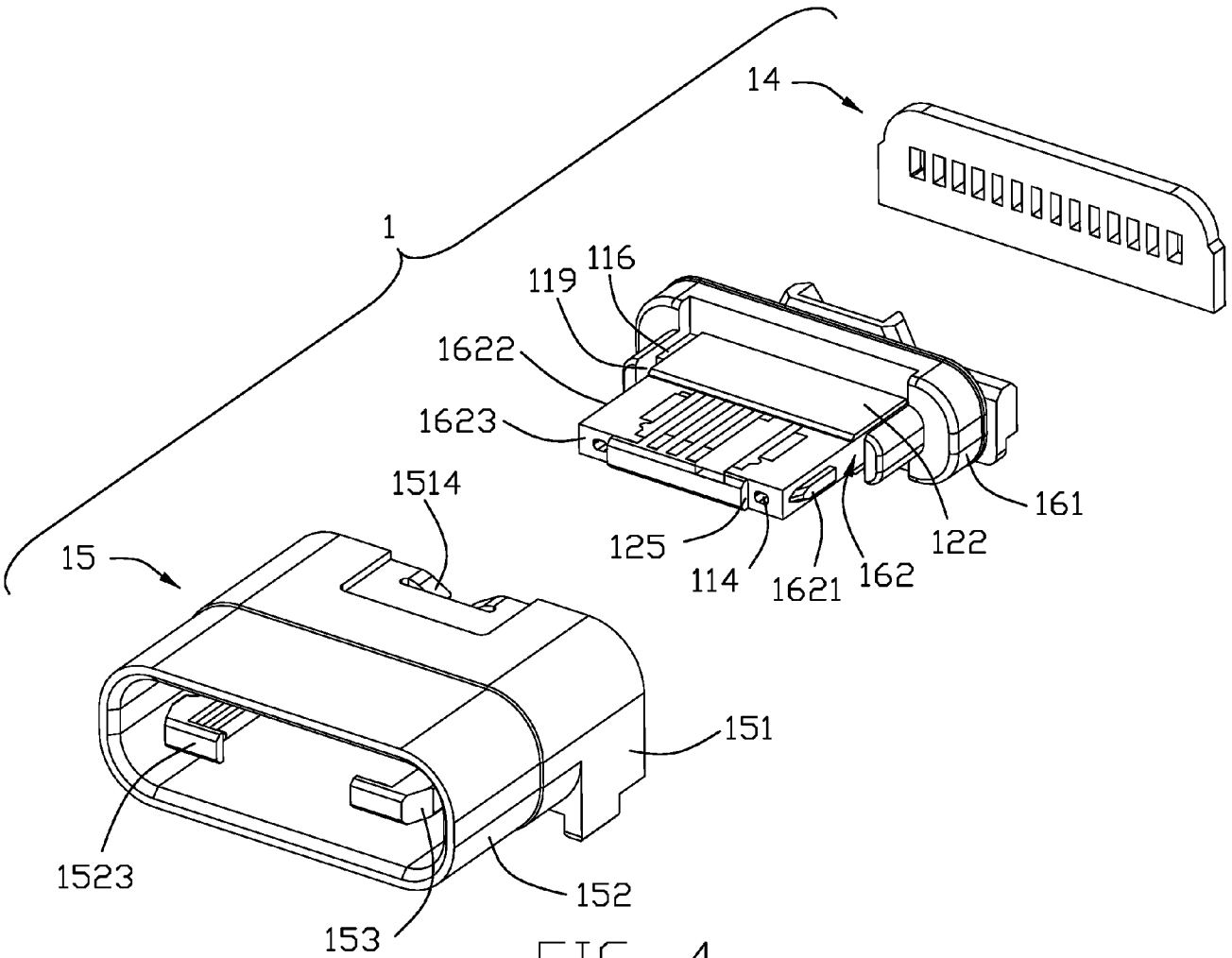
FIG. 4 is a downward further exploded perspective view of the electrical connector of FIG. 3.
Figure 5:
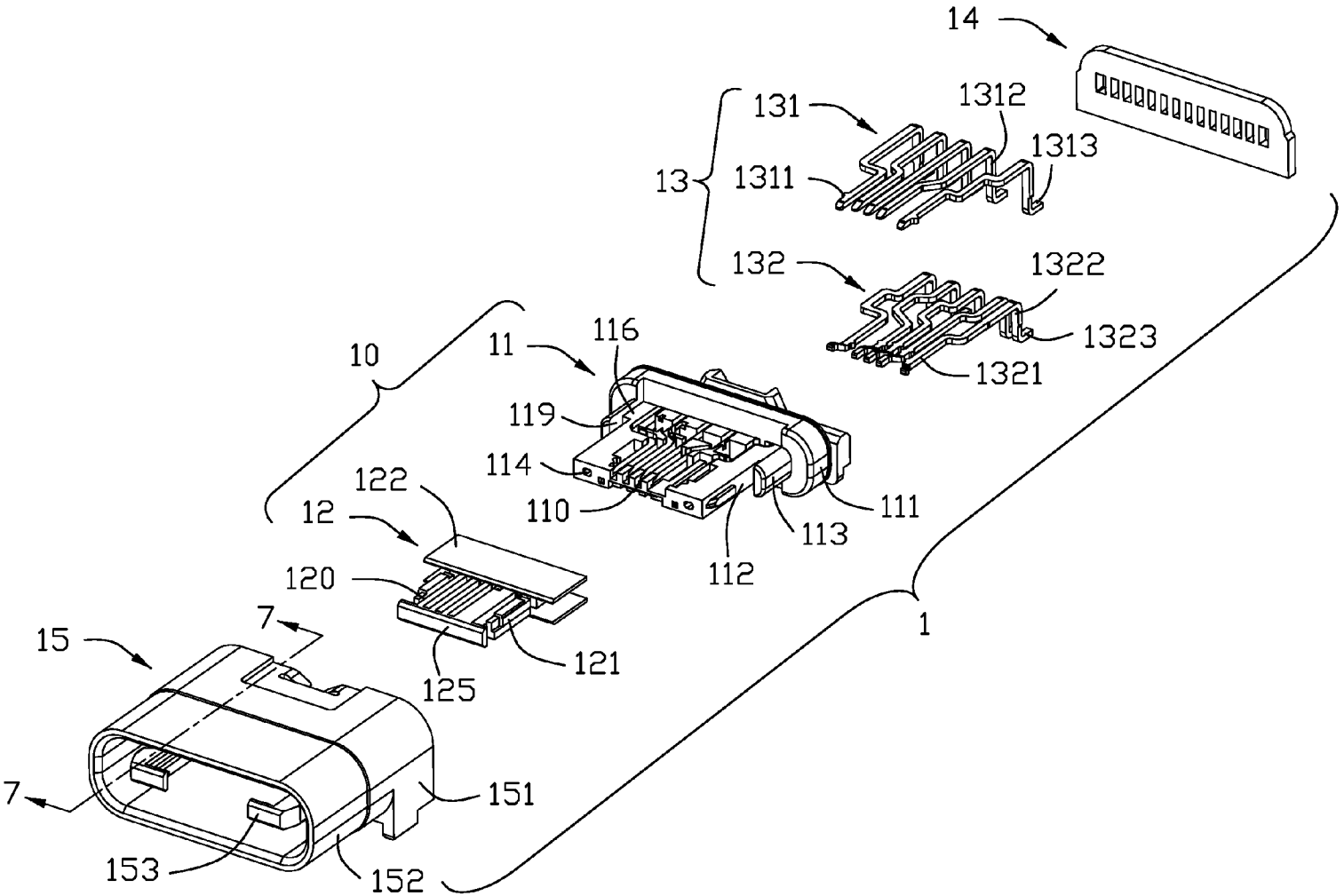
FIG. 5 is a downward further exploded perspective view of the electrical connector of FIG. 4.
Figure 6:
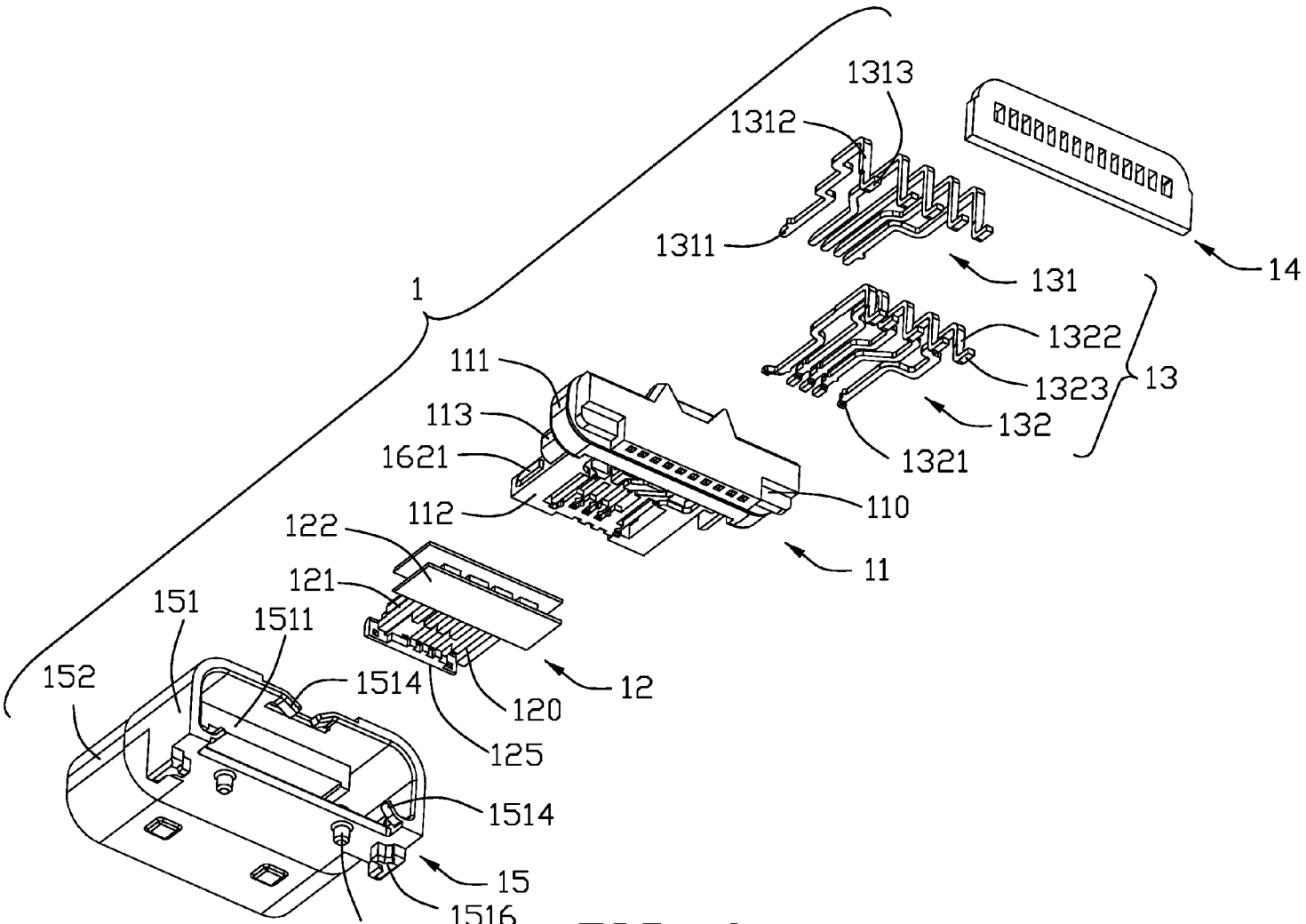
FIG. 6 is an upward exploded perspective view of electrical connector of FIG. 5.
Figure 7:
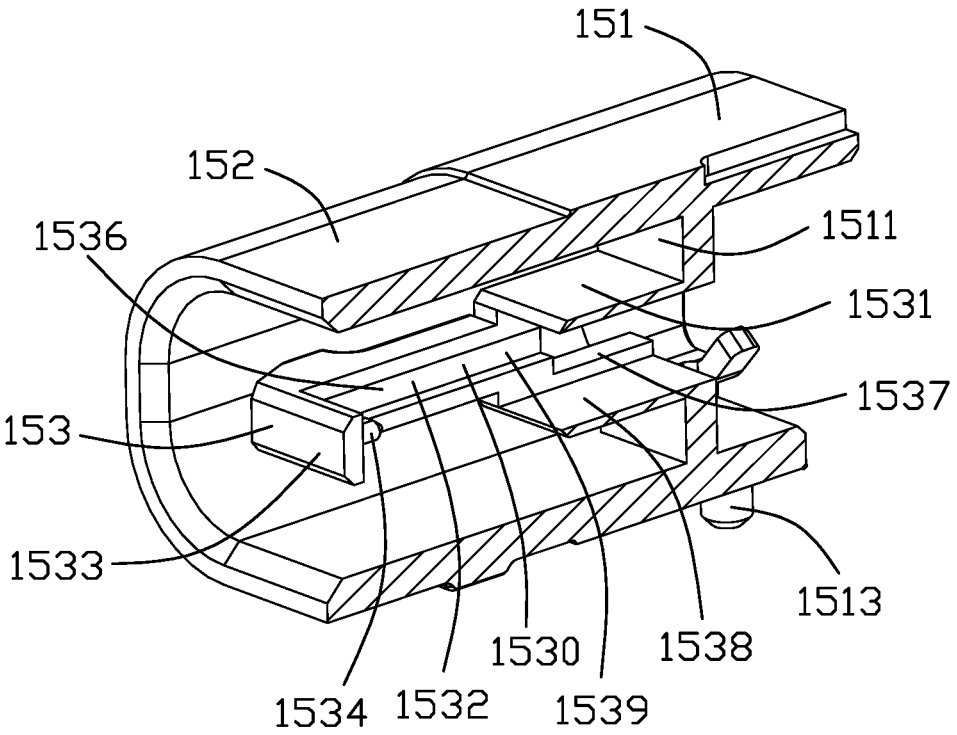
FIG. 7 is a front cross-sectional perspective view of the metallic shield of the electrical connector of FIG. 1.
Figure 8:
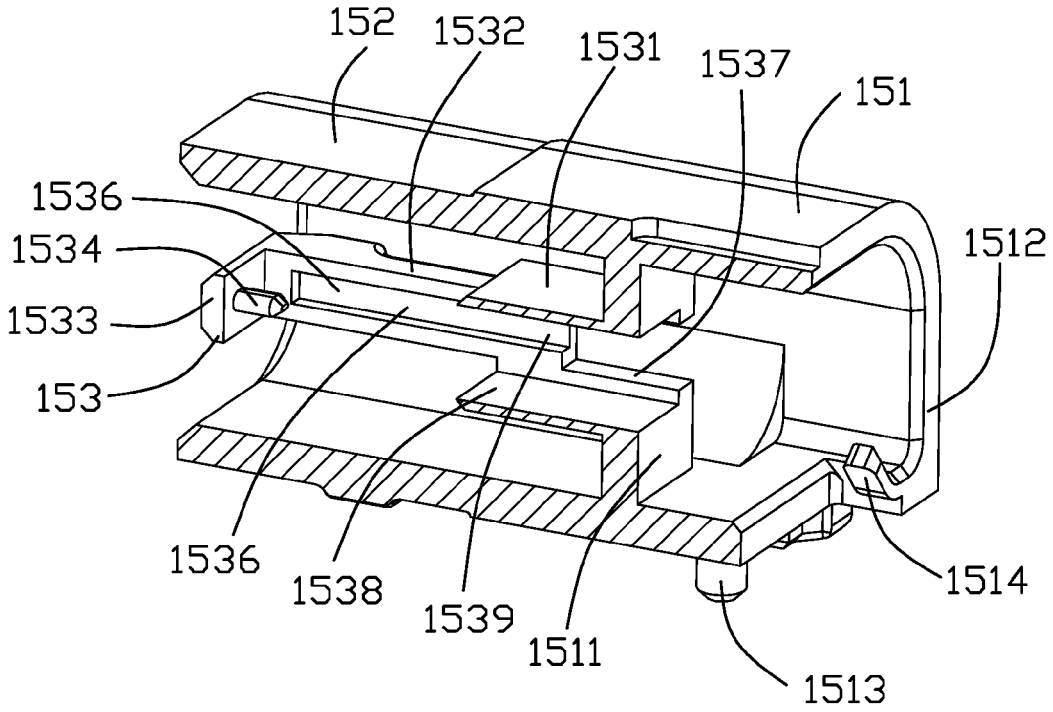
FIG. 8 is a rear cross-sectional perspective view of the metallic shield of the electrical connector of FIG. 1.
Figure 9:
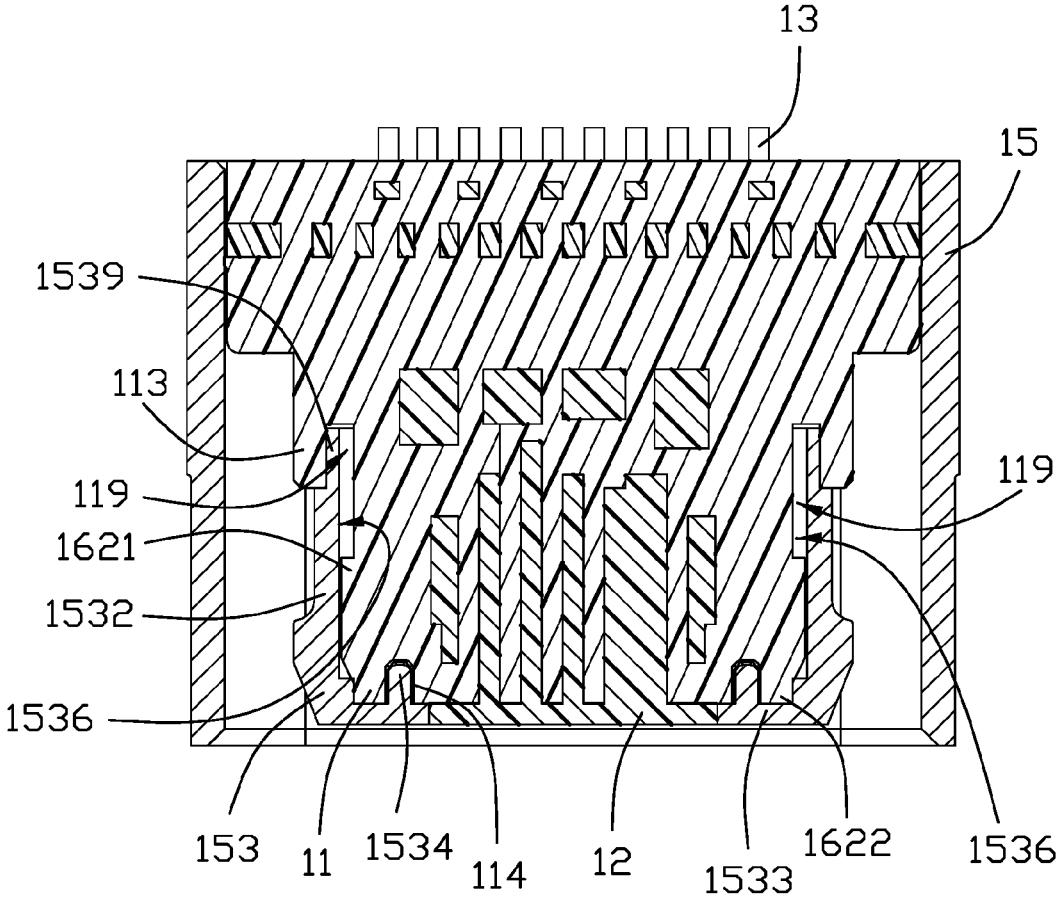
FIG. 9 is a horizontal cross-sectional view of the electrical connector of FIG. 1.
Figure 10:
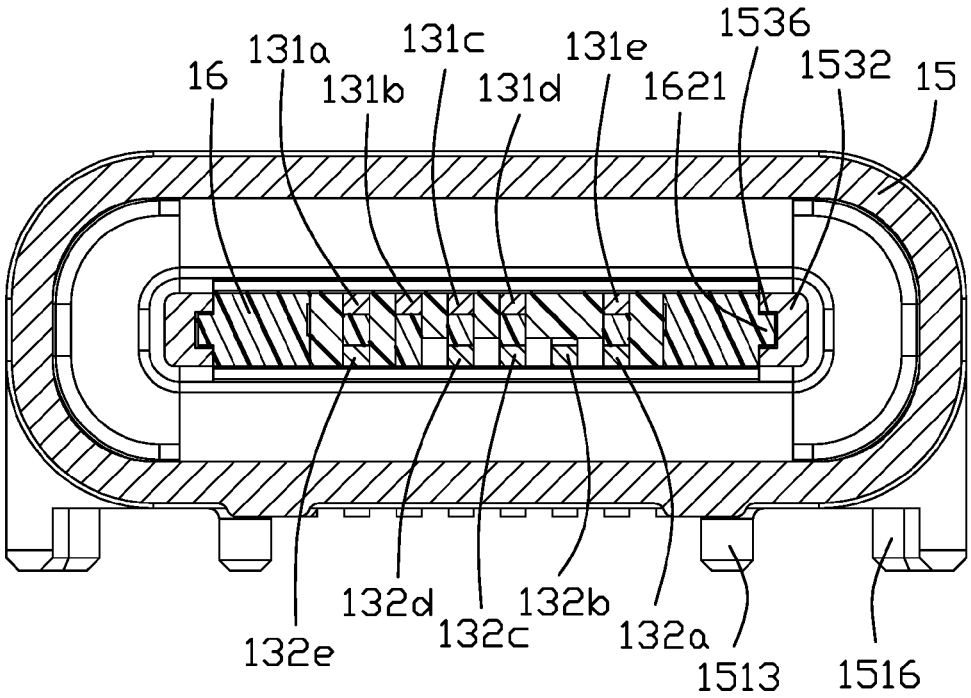
FIG. 10 is a vertical cross-sectional view of the electrical connector of FIG. 1.
Figure 11:
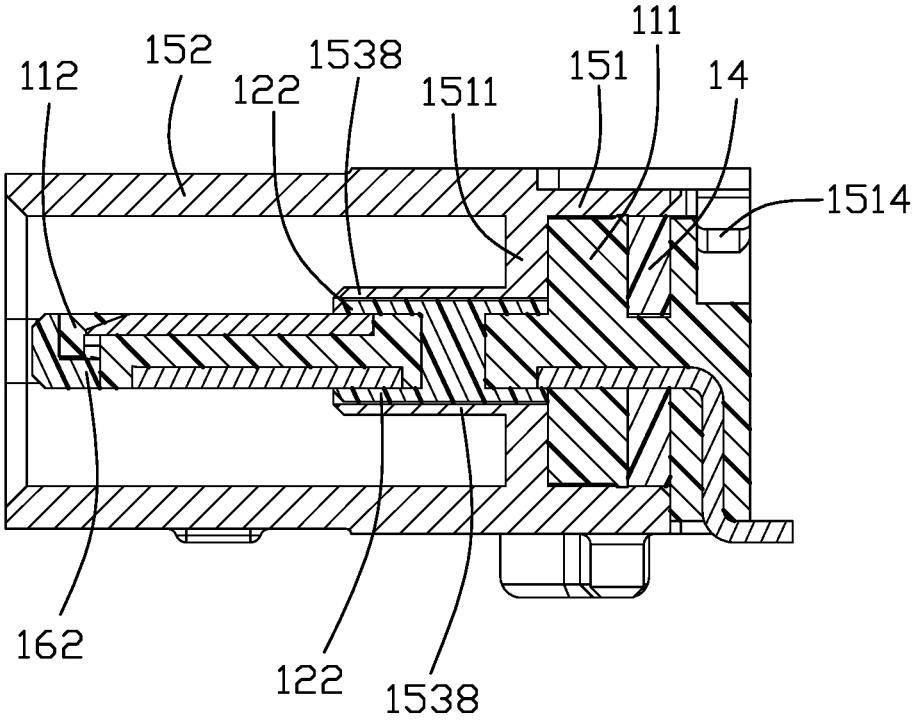
FIG. 11 is another vertical cross-sectional view of the electrical connector of FIG. 1.
Figure 12:
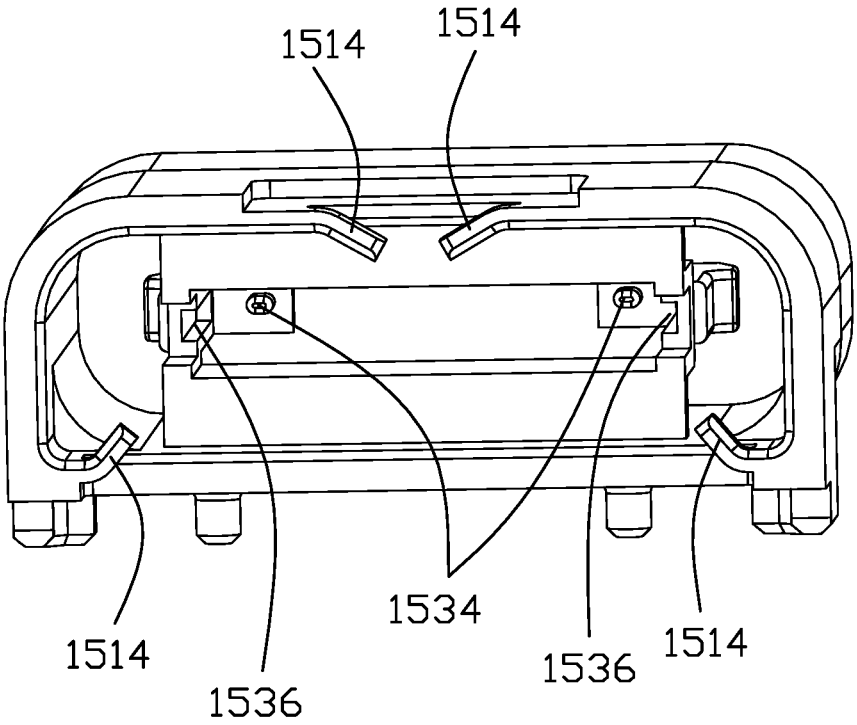
FIG. 12 is a rear perspective view of the metallic shield of the electrical connector of FIG. 1.
Figure 13:
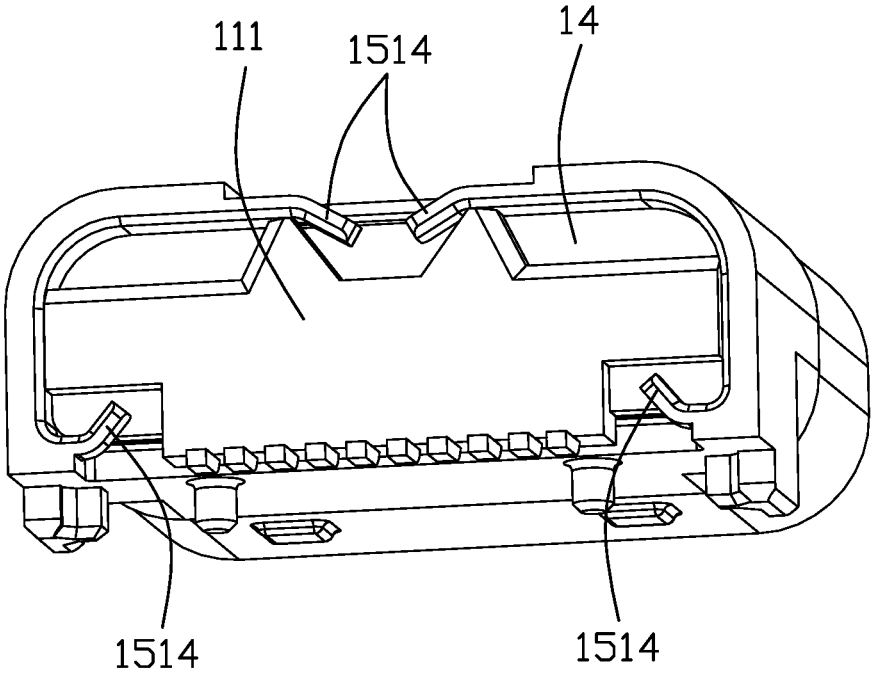
FIG. 13 is a rear assembled perspective view of the electrical connector of FIG. 1.

Referring to FIGS. 1 to 13, an electrical connector assembly 100 defines a front-to-back direction Y along the mating/withdrawal direction, a vertical direction Z perpendicular to the front-to-back direction Y, and a transverse direction X perpendicular to both the front-to-back direction Y and the vertical direction Z. The electrical connector assembly 100 includes an electrical connector 1 and a printed circuit board 2 on which the electrical connector 1 is mounted. The electrical connector 1 includes an insulative housing 16, a plurality of conductive contacts 13 disposed in the housing 16, a metallic shield 15 enclosing the insulative housing 16, and a glue plate 14 located behind the insulative housing 16 in the metallic shield 15.

The insulative housing 16 includes a first insulator 11 which is insert-molded with the conductive contacts 13, and a second insulator attached upon the first insulator 11. The first insulator 11 includes a first base 111, a first tongue portion 112 extending forwardly from the first base 111, a pair of poles 113 located at two opposite transverse ends of the root region of the first tongue portion 112, and a plurality of first passageways 110 for receiving the corresponding contacts 13, respectively. Each pole 113 is spaced from the lateral side of the first tongue portion 112 with a slot 119 therebetween in the transverse direction. The front edge of the first tongue portion 112 forms a pair of holes 114. The second insulator 12 enclosing the first tongue portion 112 via a second/successive insert-molding process, includes a first block 121 to be engage with the first tongue portion 112, a pair of second blocks 122 to cover two opposite faces of the areas between the pair of poles 113 of the first tongue portion 112, a protrusion 125 on a front edge, and a plurality of second passageways 120.

The conductive contacts 13 include one row of first contacts 131 and another row of second contacts 132. The five first contacts and the five second contacts are reversely symmetrical with each other, i.e., diagonally symmetrical with each other, wherein the first contacts 131, from left to right, are the power contact 131*a*, the function contact 131*b*, the signal contact 131*c*, the signal contact 131*d* and the power contact 131*e*. Similarly, the second contacts 131, from right to left, are the power contacts 132*a*, the function contact 132*b*, the signal contact 132*c*, the signal contact 132*d* and the power contact 132*e*. The first contact 131 and the second contact 132 have the contacting section 1311, 1321, the soldering section 1313, 1323, and the connecting section 1312 and 1322 linked therebetween. The soldering sections 1313 of the first contacts 131 and the soldering sections 1323 of the second contacts 132 are located at a same plane. The plane where the soldering sections 1313 and 1323 are located, is located under and parallel to the plane where the contacting sections 1311 and 1321 are located while perpendicular to the plane where the connecting sections 1312 and 1322 are located.

The metallic shield 15 is made via powder metallurgy and includes a main body 151, the tubular section 152 extending from the main body 151 and enclosing the first tongue portion 112, and the metallic inner part 153 extending from the main body 151 inside the tubular section 152. The main body 151 includes the rear wall 1512 and the stopping arm 1514 extending from the rear wall 1512, a pair of mounting posts 1513 for securing to the printed circuit board 2, a pair of mounting seats 1516 for mounting to the printed circuit board 2, and a vertical connecting wall 1511 which is forwardly spaced from the rear wall 1512 with a distance and located around a border between the main body 151 and the tubular section 152 for connecting to the inner part 153.

The inner part 153 includes a frame structure 1531 extending forwardly from the connecting wall 1511, a pair of side arms 1532 extending from two sides of the frame structure 1531, a pair of front arms 1533 extending from free ends of the corresponding side arms 1532, respectively, toward each other in a perpendicular manner with regard to the corresponding side arms 1532, and a pair of positioning posts 1534 extending from inner side of the corresponding front arms 1533 toward a middle portion of the inner part 153, wherein all the frame structure 1531, the pair of side arms 1532 and the pair of front arms 1533 commonly form a receiving cavity or space 1530. The frame structure 1531 includes two parallel opposite metal plates 1538 and two opposite side plates 1539 linked therebetween. The plates 1538 cover opposite upper and lower surfaces of the root region of the tongue portion 112 while side plates 1539 only link front portions of the plates 1538 but forming cutouts 1537 around rear portions of the plates 1538. The side plates 1539 are received within the corresponding slot 119. The joint section of the pole 113 and the first tongue portion 112 is received in the corresponding cutout 1537. The side plate 1539 abuts against an inner face of the pole 113. The side arm 1532 forms a groove 1536.

After the second insert-molding process, the second insulator 12 is applied upon the first insulator 11 to commonly form the insulative housing 16 which includes a main base 161, and a tongue portion 162 extending forwardly from the main base 161, of which the side face 1622 and the front face 1623 abut against the side arm 1532 and the front arm 1533, respectively. A block 1621 extends from the corresponding side face 1622 outwardly and into the groove 1536 of side arm 1532. The positioning post 1534 is received within the corresponding hole 114. The second insulator 12 has a protrusion 125 located between the pair of front arms 1533.

In assembling, the positioning posts 1534 of the inner part 153 are received within the corresponding holes 114 of the housing 16, respectively, the tongue portion 162 is received within the receiving cavity 1530 of the inner part 153, the blocks 1621 are received within the grooves 1536 of the corresponding side arms 1532, respectively, and the second blocks 122 are received within the frame structure 1531. The opposite top and bottom faces of the side arms 1532 are respectively flush with opposite surfaces of the first tongue portion 112 and exposed to an exterior. Understandably, the opposite top and bottom faces of the side arm 1532 are used to replace the original grounding contacts which are respectively located at the outermost positions of the contacts in the traditional connector. Therefore, during mating, the opposite top and bottom faces of the side arms 1532 will contact the corresponding grounding terminals in the complementary plug connector (not shown).

After assembled, the poles 113 abut against the side plates 1539, the blocks 1621 are received within the corresponding groove 1536, the front face 1623 abuts against the front arms 1533, the protrusion 125 sidewardly abuts against two front arms 1533. Therefore, the insulative housing 16 and the inner part 153 are mutually supportably engaged with each other, thus preventing the outward/lateral movement of the front free ends of the side arms 1532 away from each other. The printed circuit board 2 has the corresponding through holes 21 for coupling with the mounting posts 1513, and the corresponding mounting holes 22 for coupling with the mounting seats 1516, and a plurality of conductive pads for coupling to the conductive contacts 13.

In brief, from one viewpoint, compared with and/or referring to the aforementioned U.S. Pat. No. 9,525,227, the invention uses the side arms 1532 to further replace the two pairs of outermost grounding contacts of the traditional Type C receptacle connector for mating with a complementary plug connector, and uses the opposite top and bottom metal plates 1538 of the frame structure 1531 which form the step structures with regard to the tongue portion 162 to further replace the discrete collar which is originally assembled upon the root region of the tongue portion of the traditional Type C receptacle connector for mating with a complementary plug connector, thus simplifying the related structures.

From another technical viewpoint, in the invention the die-casting metallic shield is stronger than the formed/stamped metallic shield used in the traditional connector, and the tongue portion is now equipped with the die-casting side arms 1532 and front arms 1533 to have reinforced structure along the edges, thus resulting in mutual engagement therebetween to enhance the whole tongue portion 162 for enduring the severe mating wherein such mutual engagement is derived from at least one of the following structural relations including the positioning posts 1534 received within the corresponding hole 114, the block 1621 received in the groove 1536, the second blocks 122 received in the frame structure 1531, and the side plates 1539 received within the corresponding slots 119.

In this embodiment, the vertical connecting wall 1511 prevents forward movement of the insulative housing 16 while the stopping arms 1514 prevent rearward movement of the insulative housing 16 so as to have the insulative housing 16 fixed relative to the shield 15 along the front-to-back direction. Notably, the confrontation between the front arms 153 and the front edge of the first tongue portion 112, and that between the side arms 152 and the poles 113 are also helpful for retention between the insulative housing 16 and the metallic shield 15 in the front-to-back direction. Another feature of the invention is that the die-casting shield 15 has different thicknesses at different positions for complying with the required rigidity thereof wherein the stopping arms 1514 are intentionally thinned for easy bending to stop the backward movement of the housing 16 after the housing 16 is assembled into the shield 15. Moreover, in this embodiment the frame structure is essentially of a complete loop to have the opposite top and bottom plates 1538 and two opposite side plates 1539. Understandably, it is not necessary to have the loop circumferentially continuous.

However, the disclosure is illustrative only, changes may be made in detail, especially in matter of shape, size, and arrangement of sections within the principles of the invention.

What is claimed is:

1. An electrical connector comprising:

a unitary metallic shield including a main body, a tubular section forwardly extending from the main body in a front-to-back direction, and an inner part located in the tubular section and extending forwardly in said front-to-back direction and defining a receiving cavity therein;

an insulative housing enclosing within the metallic shield and including a main base and a tongue portion forwardly extending from the main base in said front-to-back direction; and a plurality of contacts disposed in the housing; wherein the tongue portion is protectively and snugly received within the receiving cavity for mating;

wherein said inner part including a frame structure, a pair of side arms spaced from each other in a transverse direction perpendicular to said front-to-back direction and forwardly extending from two opposite lateral sides of the frame structure in said front-to-back direction; and said tongue portion forwardly extends through the frame structure in said front-to-back direction, and two lateral sides of the tongue portion are protectively engaged with the corresponding side arms so as to form a reinforced tongue portion for mating.

2. The electrical connector as claimed in claim 1, wherein said pair of side arms are configured and positioned to function as grounding contacts for mating with corresponding grounding terminals of a complementary plug connector.

3. The electrical connector as claimed in claim 1, wherein said inner part further includes a pair of front arms respectively extending from free ends of the corresponding side arms toward each other in the transverse direction, and a front edge region of the tongue portion forwardly abuts against the corresponding front arms in the front-to-back direction.

4. The electrical connector as claimed in claim 3, further including means for retaining the front edge region of the tongue portion to the corresponding front arms in a vertical direction perpendicular to both said front-to-back direction and said transverse direction.

5. The electrical connector as claimed in claim 3, wherein said tongue portion further includes a protrusion on the front edge region between the pair of front arms in the transverse direction.

6. The electrical connector as claimed in claim 1, further including means for retaining the lateral sides of the tongue portion to the corresponding side arms, respectively, in a vertical direction perpendicular to both said front-to-back direction and said transverse direction.

7. The electrical connector as claimed in claim 1, wherein said frame structure forms a complete loop circumferentially, and extends along the front-to-back direction with a distance to include opposite top and bottom plates for grounding during mating with a complementary connector.

8. The electrical connector as claimed in claim 1, wherein the metallic shield is made via die-casting and has different thicknesses at different positions, and includes a plurality of stopping arms having a less thickness compared with remaining portions thereof.

9. The electrical connector as claimed in claim 1, wherein said insulative housing further defines a slot around a root region of the tongue portion, in which a side plate of the frame structure is received.

10. A method of making an electrical connector, comprising steps of:

providing a unitary metallic shield via a die-casting process with a main body, a tubular section extending forwardly from the main body along a front-to-back direction, and an inner part located in the tubular section and extending forwardly in the front-to-back direction and having a pair of side arms to form a receiving cavity;

providing an insulative housing with a plurality of contacts therein wherein said housing includes a main base and a tongue portion extending forwardly from the main base;

providing the plurality of contacts disposed within the insulative housing; and forwardly inserting the tongue portion of the insulative housing into the receiving cavity; wherein two opposite lateral side edges of the tongue portion are protectively and intimately engaged with the side arms, respectively;

wherein said inner part further has a frame structure from which a pair of side arms extend forwardly from two opposite lateral sides of the frame structure, respectively.

11. The method as claimed in claim 10, further including a step of providing said pair of side arms with a pair of front arms linked to corresponding free ends, respectively, wherein a front edge region of the tongue portion abuts against the pair of front arms in the front-to-back direction.

12. The method as claimed in claim 11, further including a step of providing a protrusion on a front edge region of the tongue portion to be located between the pair of front arms in a transverse direction perpendicular to said front-to-back direction.

13. The method as claimed in claim 10, further providing means for engaging the lateral side edges of the tongue portion with the corresponding side arms, respectively, or means for engaging the front arms with the front edge region of the tongue portion.

14. An electrical connector comprising:

a unitary metallic shield including a main body, a tubular section forwardly extending from the main body in a front-to-back direction, and an inner part located around a border of the main body and the tubular section and including a frame structure having at least opposite top and bottom plates, an insulative housing enclosing within the metallic shield and including a main base and a tongue portion forwardly extending from the main base in said front-to-back direction; and a plurality of contacts disposed in the housing; wherein the tongue portion forwardly extends through the frame structure in said front-to-back direction, and said top and bottom plates form step structures with regard to the tongue portion to function as a grounding device which is adapted for mating with a grounding part of a complementary connector.

15. The electrical connector as claimed in claim 14, wherein said inner part is connected to the border via a vertical connecting wall.

16. The electrical connector as claimed in claim 14, further including a pair of side arms unitarily extending from two opposite lateral sides of the frame structure to protective engagement with corresponding side edge regions of the tongue portion for reinforcement of the tongue portion.

17. The electrical connector as claimed in claim 16, further including a pair of front arms unitarily extending from free ends of said pair of side arms toward each other for protective engagement with a front edge region of the tongue portion.

18. The electrical connector as claimed in claim 17, further including a protrusion formed on the front edge region of the tongue portion and located between said pair of front arms in a transverse direction perpendicular to said front-to-back direction.

* * * * *